United States Patent [19]

Fry

[11] 4,121,693

[45] Oct. 24, 1978

[54] METHOD AND MEANS RELATING TO HIGH RISE BUILDING ACCESS FOR FIRE FIGHTING PURPOSES

[76] Inventor: Philip W. Fry, 7 Culford Ave., Klemzig, South Australia, Australia, 5087

[21] Appl. No.: 753,590

[22] Filed: Dec. 22, 1976

[30] Foreign Application Priority Data

Dec. 24, 1975 [AU] Australia ..... PC4405

[51] Int. Cl.[2] ..... A62B 1/02

[52] U.S. Cl. ..... 182/131; 182/144; 182/223; 187/6

[58] Field of Search ..... 182/70, 82, 133, 142, 182/150, 143, 144, 131, 223; 187/6

[56] References Cited

U.S. PATENT DOCUMENTS

| | | | |
|---|---|---|---|
| 665,707 | 1/1901 | Tromanhauser | 182/142 |
| 4,018,306 | 4/1977 | Lyons | 182/142 |

*Primary Examiner*—Reinaldo P. Machado

*Attorney, Agent, or Firm*—Oldham, Oldham, Hudak & Weber Co.

[57] ABSTRACT

An arrangement for assisting access to a high rise building in the event of fire within the building in which chains are secured to a movable frame so that when the apparatus is in an extended position, the chains hang well away from the face of the building, and a cabin can engage the chains which can be held stabilized by downward tension, and the cabin being self-climbing, can provide the said access to the building.

1 Claim, 3 Drawing Figures

Figure 2:
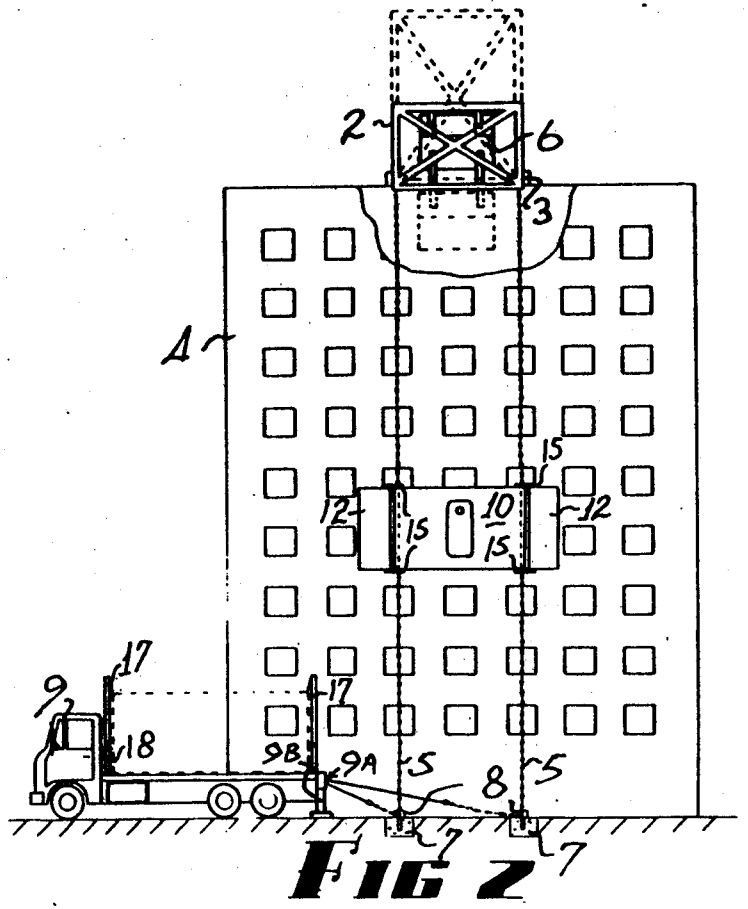

METHOD AND MEANS RELATING TO HIGH RISE BUILDING ACCESS FOR FIRE FIGHTING PURPOSES

This invention relates to a method and means for obtaining access to high rise buildings for purposes of fire fighting and otherwise.

BACKGROUND OF INVENTION

At the present time it is a well known problem that many high rise buildings are higher than can be reached by facilities available to the local fire fighting officials, and in cases of fire and/or earthquakes in such buildings, other means of access to the higher stories of the building must be used or the fire must be left, with often disastrous results to both the building and people who may be trapped above the fire.

It is a well known fact that when fighting a fire in a taller building, it is important that any fire fighting techniques are better used from above the fire than from below the fire and it is therefore of the utmost importance if it is at all possible in practical terms, that fire fighting equipment and personnel be able to reach upper stories of a high rise building.

The difficulty is of course the problem of finding means which are both economical in a practical sense and at the same time are reliable.

OBJECTS OF THIS INVENTION

It is the object generally of this invention to propose means and a method by which access for fire fighting purposes to the higher stories of any high rise building can be reached in a practical as well as economic sense.

STATEMENT OF THE INVENTION

This invention can be said to reside in an arrangement for assisting access to a high rise building in the event of fire within the building, characterized by including a support apparatus secured to the structure of the building and positioned at or toward an uppermost part of the building, and having at least one position in which a portion of the apparatus extends outwardly past the side of the building, at least two chains each having an upper end supported by the said support apparatus, and each hanging downwardly from this supported end, so that, with the apparatus in the stated position, each chain hangs substantially away from the face of the building, each chain being at least substantially the height of the building, and the anchor means situated below each chain, and adapted to provide reaction for stabilizing means to engage and hold the said chains under applied stabilizing tension.

It will be seen that such an arrangement provides a support for a cabin, which can separately rise by engagement of the chain, independently of any services within the building, and by being situated away from the face of the building, such cabin will not be immediately vulnerable to heat or smoke or falling objects emanating from a portion of the building subject to fire.

It is a feature of the arrangement, that the chains are adapted to hang "substantially away from the face of the building" and this phrase must be interpreted with a knowledge of the function intended for the chains.

It is an important feature that the cabin should not be immediately adjacent the face of any building in that this will cause it to be vulnerable to any flame or smoke or falling objects emanating from the building, and the distance must therefore be selected in light of the various practical factors that must be taken into account, such as the distance necessary for any cabin so that in the event of a worst case fire, the cabin can still rise past the flames without danger to the persons within the cabin.

There is also an aspect relating to the chains themselves, in that these should not be so close as to be in danger of being destroyed by any flames emanating in the case of a worst fire.

It is a preferred feature that the support apparatus be secured to the building by support means which are arranged such that the support apparatus can assume a retracted position in which the supported chains will hang in a position adjoining the face of the building.

It would normally be expected that the chains would lie either against the face of the building or in a protective cover protected against corrosion or some crevice along the face of the building, and only in the event of either practice or fire, would they be engaged and pulled out so as to take their position substantially away from the face of the building.

The invention can also reside of course in the combination of the arrangement as first described, together with a cabin which has chain engaging means at or toward each side, and which is supported in an elevated position by such chain engaging means engaging each of the said hanging chains, the chains in each case being held under additional tension by means passing through pulley blocks secured to said anchor means.

While the purpose of the cabin is to provide elevated access independent of any internal services of the building, it also can be used for extracting persons otherwise trapped within the building and it will be appreciated therefore that interconnection with the cabin and the building is an important aspect.

It is a preferred feature therefore that the cabin have an extendable walkway capable of providing access with respect to windows in the face of said building, adjacent which it is positioned.

It is a feature of the arrangement that with two chains, the cabin can be stably supported, that is in respect of turning about a vertical axis, but the chains can still be subject to buffeting, either from wind or by air currents caused by a fire or other means, and as has been previously set out, the chains are to be stabilized by applying tension through a reaction anchor means.

It is a feature that the vehicle which would normally be used to bring the cabin to the building site, can also be used to apply the tension to the respective chain, and the vehicle can do this either by having preferably winches or by simply attaching through cables or otherwise, the ends of the chains through the pulley blocks of the anchor means and exerting tension by use of the vehicle transmission.

It is a preferred arrangement that the support apparatus supporting the ends of the chains be supported by a pivot connection to the building, the pivot connection being substantially horizontal and transverse to the face down which the chains hang, and the support apparatus being such that in its retracted position, the ends of the chain are held substantially above the pivot axis.

It is preferable of course to counterweight the weight of the chain, and this has the advantage that when necessary, personnel can engage the chains from a lowermost position, and by even gentle pressure, pull these, and the apparatus will assume an extended position with minimal effort, from below.

Figure 1:
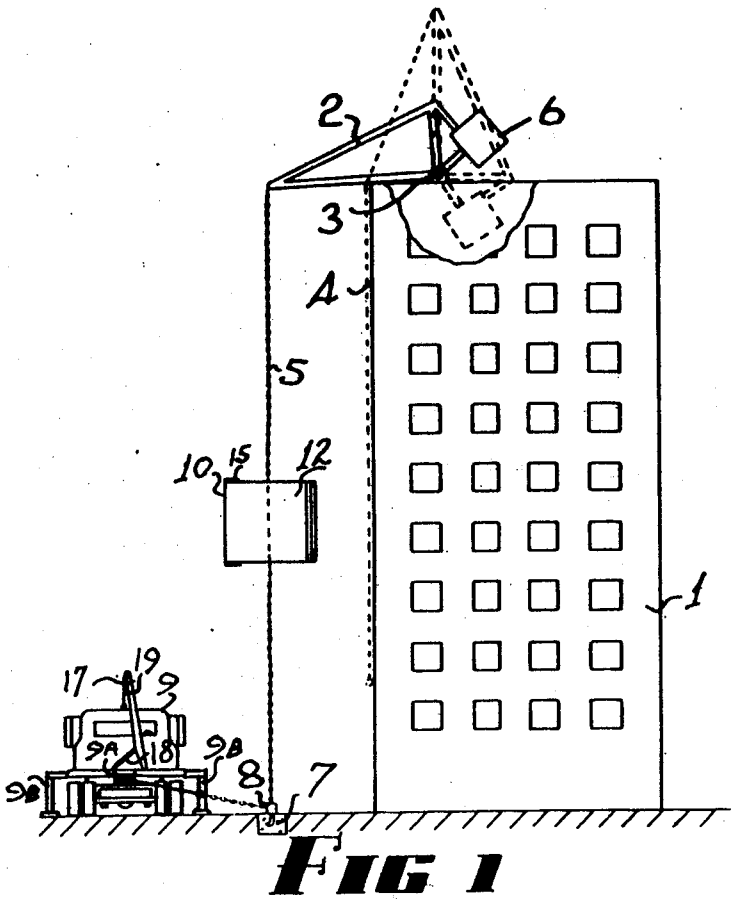
Figure 3:
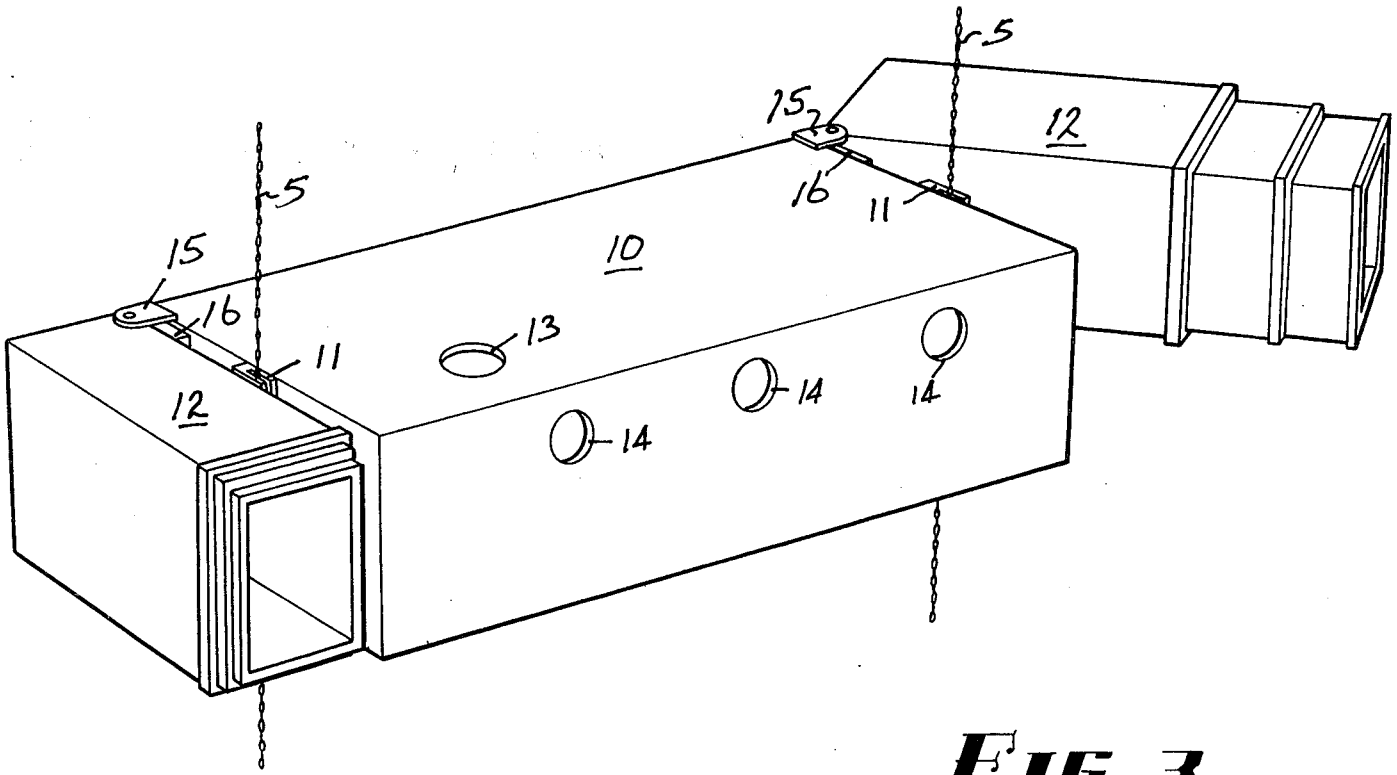

The invention will now be described with respect to a preferred embodiment which will be described with the assistance of drawings, in which:

FIG. 1 is a side elevation showing schematically a high rise building with a support apparatus positioned in an uppermost position on the building, the support apparatus being shown in the extended position and showing the retracted position in dotted detail, FIG. 2 is a front view of the arrangement as shown in FIG. 1, and FIG. 3 is a perspective view of a cabin as is shown in FIGS. 1 and 2.

Referring now to the drawings in detail, the high rise building 1, has secured to the structure of the building which will always be the most basic framework of the building which normally will not be destroyed even in a worst fire, a support apparatus which, in this case, is a frame 2, this support frame being secured to the building through a pivot connection 3, which is of course, positioned so as to be substantially horizontal and transverse to the face 4 of the building 1 down which the chains 5, hang.

The support frame 2 is counterweighted by weight 6, to at least to some extent counterbalance the weight of the chains 5 through the rotation from position as is shown in full line to the position as is shown in dotted line.

It will be noted that in the extended position the chains 5 are a substantial distance away from the face 4 of the building 1, and this might in practice, be perhaps fifteen or twenty feet, depending of course upon practical circumstances and design factors which will be familiar to those expert in this art.

Situated below the chains 5, are anchor means 7 which include an arrangement not specifically shown in the drawings in which there is a recessed hook to which a "snatch block" 8, can engage, the "snatch block" having a pulley, and a side bracket removable so that the chain can be fed quickly to engage around the pulley, and then be secured to the truck 9, by which tension can be applied in a stabilizing manner to the chains 5. The tension will be applied by reason of the fact that the truck 9 applies forward pressure through a winch 9A and by the resilient pressure through its tyres, and outrigger rams 9B will maintain a high tension which will provide the stabilizing effect on the chains 5.

The cabin 10 has internally, engaging means at each end which are operable from an internal combustion engine, so as to engage and thereby lift the cabin with respect to the chains 5. The chains 5 are fed through extendable walkways slots 11.

The cabin 10 has extendable walkways 12, by which personnel within the cabin can gain protected access to any of the windows up past which the cabin can rise, the walkway 12 being shown in each case i.e. in FIGS. 1 and 3, in either a partially extended position or recessed position.

The cabin 10 is shown with viewing portholes 14 which are especially arranged so as to resist high temperatures, and are intended to enable fire fighting personnel to both see and if necessary direct water through each of the portholes 14.

There is also not shown in the drawings, a lower trapdoor and an upper porthole 13, which can be used for emergency exit or for fighting of fires from this vantage point.

The walkways 12 are pivotally supportable by brackets 15 to the main cabin 10 and there is access internally at 16. The walkways 12 can be swung to connect to various windows of the same level.

The cabin 10 can be supported for transport on the truck 9 but can be raised from the truck and into a climbing position by arms 17 controlled by rams 18 coupling with the cabin through chains 19.

This then describes a preferred embodiment.

It will be seen that the proposal providing chains kept at a distance away from the face of the building but kept also stable, can provide a universal means by which a cabin can gain access without relying upon any of the essential utilities within a building.

While reference has been made to "chain" and it is presently considered that "chain" is the most suitable form of providing the flexible elongated support members, it is not intended that the word "chain" should limit the concept to equivalents, and where a very high fire resistant and corrosion resistant cable might be developed, a cable perhaps made of high fire resistant steel could replace a "chain". However, there are more difficulties associated with obtaining a positive grip, but these do not necessarily mean the concept is not viable with members other than "chains".

I claim:

1. An arrangement for assisting access to a high rise building in the event of fire within the building, characterized by including a support frame secured to the structure of the building, and positioned at or toward an uppermost part of the building, and having at least one position in which a portion of the frame extends outwardly past the side of the building, at least two chains each having an upper end supported by the said support frame, and each hanging downwardly from the supported end, so that, with the frame in the stated position, each chain hangs substantially away from the face of the building, each chain being at least substantially of a length of the height of the building and having free lower ends, and anchor means situated below each chain and adapted to engage therewith and provide reaction for stabilizing means to engage and hold the said chains under applied stabilizing tension, the support frame being secured to the building by support means such that the support frame can assume a retracted position in which the supported chains are hanging in a position adjoining the face of the building, and a cabin supported by engagement with said chains and the cabin has an extendable walkway, said walkway being pivotally secured to a side end of said cabin and being pivotal in a horizontal plane to provide access to the building at an area spaced from the retracted positions of said chains.

* * * * *